US005839404A

United States Patent [19]

Numata et al.

[11] Patent Number: 5,839,404

[45] Date of Patent: Nov. 24, 1998

[54] INTAKE SYSTEM IN ENGINE

[75] Inventors: Tomoyuki Numata; Masahiro Kikuchi; Satoru Oohata; Katsuo Sasaki, all of Wako, Japan

[73] Assignee: Honda Giken Kogyo Kabushiki Kaisha, Tokyo, Japan

[21] Appl. No.: 833,957

[22] Filed: Apr. 11, 1997

[30] Foreign Application Priority Data

Apr. 16, 1996 [JP] Japan ..... 8-094194

[51] Int. Cl.[6] ..... F02M 35/10

[52] U.S. Cl. ..... 123/184.34; 123/184.36

[58] Field of Search ..... 123/184.34, 184.35, 123/184.36, 184.24, 184.25, 184.26, 184.53, 184.31

[56] References Cited

U.S. PATENT DOCUMENTS

| | | | |
|---|---|---|---|
| 4,702,203 | 10/1987 | Ohmi et al. | 123/184.35 |
| 4,708,097 | 11/1987 | Hatamura et al. . | |
| 4,784,091 | 11/1988 | Okada et al. | 123/184.34 |
| 4,889,093 | 12/1989 | Honma et al. | 123/184.34 |
| 4,898,125 | 2/1990 | Ampferer . | |
| 4,901,681 | 2/1990 | Pozniak et al. . | |
| 5,016,579 | 5/1991 | Suzuki et al. | 123/184.35 |
| 5,101,792 | 4/1992 | Koch . | |
| 5,220,889 | 6/1993 | Ampferer et al. . | |
| 5,638,784 | 6/1997 | Ohsuga et al. | 123/184.34 |
| 5,653,201 | 8/1997 | Hosoya | 123/184.34 |

FOREIGN PATENT DOCUMENTS

| | | |
|---|---|---|
| 0 271 811A1 | 6/1988 | European Pat. Off. . |
| 35 29 877A1 | 3/1987 | Germany . |
| 62-159725 | 7/1987 | Japan . |
| 5-65857 | 3/1993 | Japan . |
| 7-269431 | 10/1995 | Japan . |

OTHER PUBLICATIONS

Patent Abstracts of Japan, vol. 016, No. 380 (M–1295), Aug. 14, 1992.

Patent Abstracts of Japan, vol. 096, No. 004, Apr. 30, 1996.

*Primary Examiner*—Marguerite McMahon

*Attorney, Agent, or Firm*—Nikaido, Marmelstein, Murray & Oram LLP

[57] ABSTRACT

An intake manifold positioned between two banks of a V-shaped engine has a structure in which a body section and a connecting section coupled to each other with a plate-like mounting stay interposed therebetween. A support leg integrally formed on the mounting stay is fixed by a bolt to injector bases coupled to cylinder heads of the engine E. Thus, it is possible to firmly support the intake manifold by means of the mounting stay and moreover, to eliminate the need for a special fixing device for fixing the mounting stay to the intake manifold, thereby leading to a reduced number of parts.

4 Claims, 14 Drawing Sheets

INTAKE SYSTEM IN ENGINE

BACKGROUND OF THE INVENTION

1. Field of the Invention

The present invention relates to an intake system in an engine, including an intake manifold which is constructed by coupling a plurality of members to one another.

2. Description of the Prior Art

In order to firmly support an intake manifold of an engine on an engine body including a cylinder block, a cylinder head, etc., the intake manifold is conventionally fixed to a mounting stay provided on the engine body (see Japanese Patent Application Laid-open No.62-159725).

However, in and around currently used engines, a large number of auxiliaries, intake system parts, exhaust system parts and the like are arranged in a packaged form in a high density and for this reason, it is difficult to ensure space for the layout of the mounting stay. Especially, when a large-sized intake manifold having an annular resonance chamber, is mounted in an inclined- angle type V-shaped engine having a small angle between the two cylinder banks, it is difficult to support the intake manifold firmly and compactly in the conventional method, and complication of the supporting structure is inevitable.

SUMMARY OF THE INVENTION

Accordingly, it is an object of the present invention to firmly and compactly support the intake manifold by coupling a plurality of members to one another.

To achieve the above object, according to a first aspect and feature of the present invention, there is provided an intake system in an engine including an intake manifold which is constructed by coupling a plurality of members to one another, wherein the intake system includes a mounting stay clamped between the coupled surfaces of the plurality of members and supported on an intake manifold supporting member.

With the above arrangement, it is possible not only to firmly support the intake manifold by the mounting stay, but also to eliminate the need for a special fixing means for fixing the mounting stay to the intake manifold, thereby leading to a reduced number of parts.

According to a second aspect and feature of the present invention, the intake manifold supporting member is an injector base which support an injector and which is coupled to a cylinder head.

With the above construction, the intake manifold can be firmly supported without provision of a special intake manifold supporting member.

According to a third aspect and feature of the present invention, a plurality of members forming the intake manifold include a body section having a substantially U-shaped collection intake pipe, and a connecting section which connects opposite ends of the body section to define an annular resonance chamber.

With the above construction, the mounting stay can be disposed inside the annular resonance chamber to make it compact.

The above and other objects, features and advantages of the invention will become apparent from the following description of the preferred embodiment taken in conjunction with the accompanying drawings.

BRIEF DESCRIPTION OF THE DRAWINGS

FIGS. 1 to 16 illustrate an embodiment of the present invention, wherein FIG. 1 is a plan view of a V-shaped 6-cylinder engine;

FIG. 2 is a sectional view taken along a line 2—2 in FIG. 1;

FIG. 3 is a plan view of an intake manifold;

FIG. 4 is an exploded plan view of the intake manifold;

FIG. 5 is an enlarged view of an essential portion shown in FIG. 1;

FIG. 6 is a sectional view taken along a line 6—6 in FIG. 5;

FIG. 7 is a sectional view taken along a line 7—7 in FIG. 5;

FIG. 8 is a sectional view taken along a line 8—8 in FIG. 5;

FIG. 9 is an enlarged view of an essential portion shown in FIG. 1;

FIG. 10 is a sectional view taken along a line 10—10 in FIG. 9;

FIG. 11 is a sectional view taken along a line 11—11 in FIG. 9;

FIG. 12 is a sectional view taken along a line 12—12 in FIG. 9;

FIG. 13 is an enlarged view of an essential portion shown in FIG. 1;

FIG. 14 is a sectional view taken along a line 14—14 in FIG. 13;

FIG. 15 is an enlarged view of an essential portion shown in FIG. 1; and FIG. 16 is a sectional view taken along a line 16—16 in FIG. 15.

DETAILED DESCRIPTION OF THE PREFERRED EMBODIMENT

Figure 1:
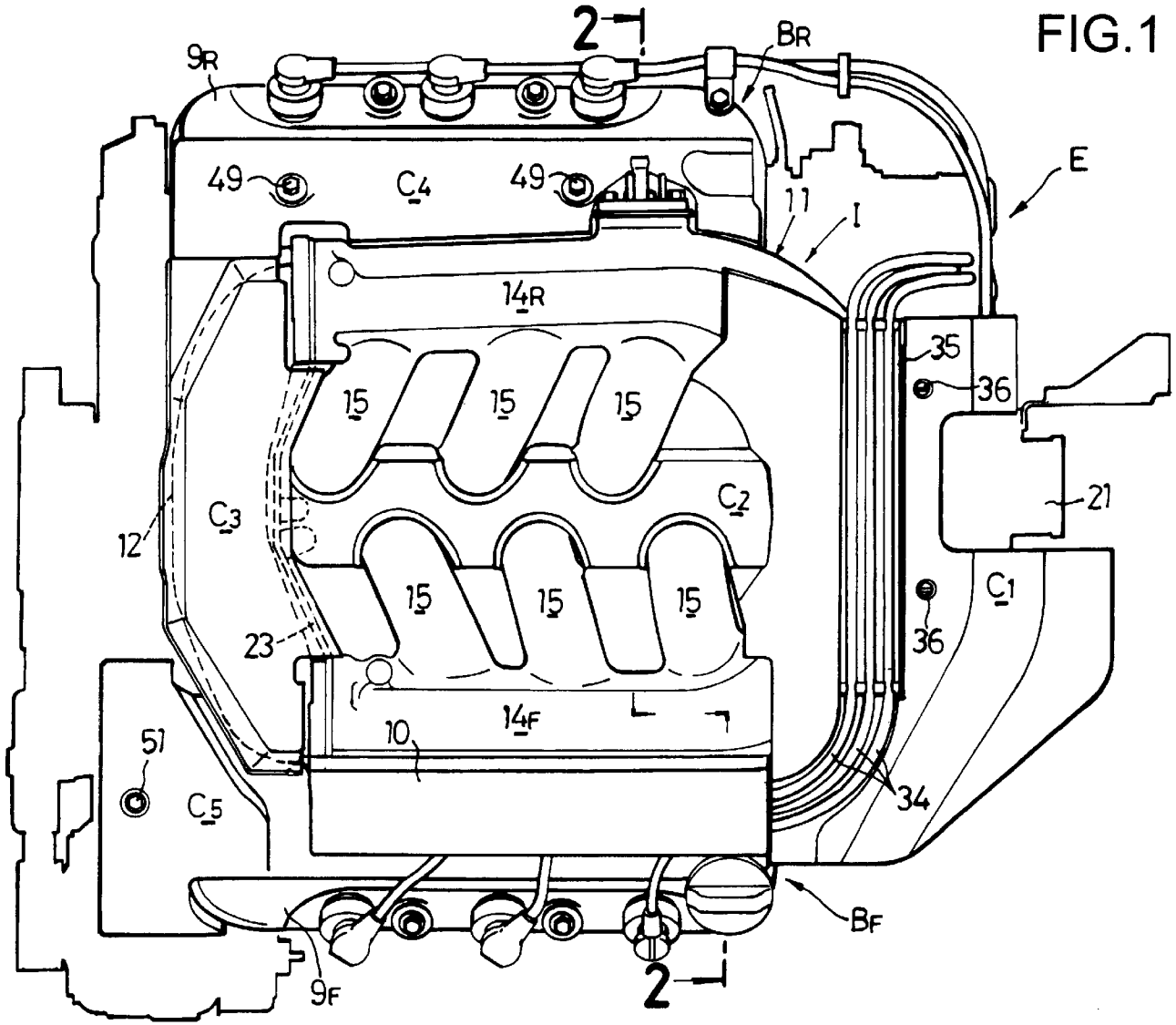
Figure 2:
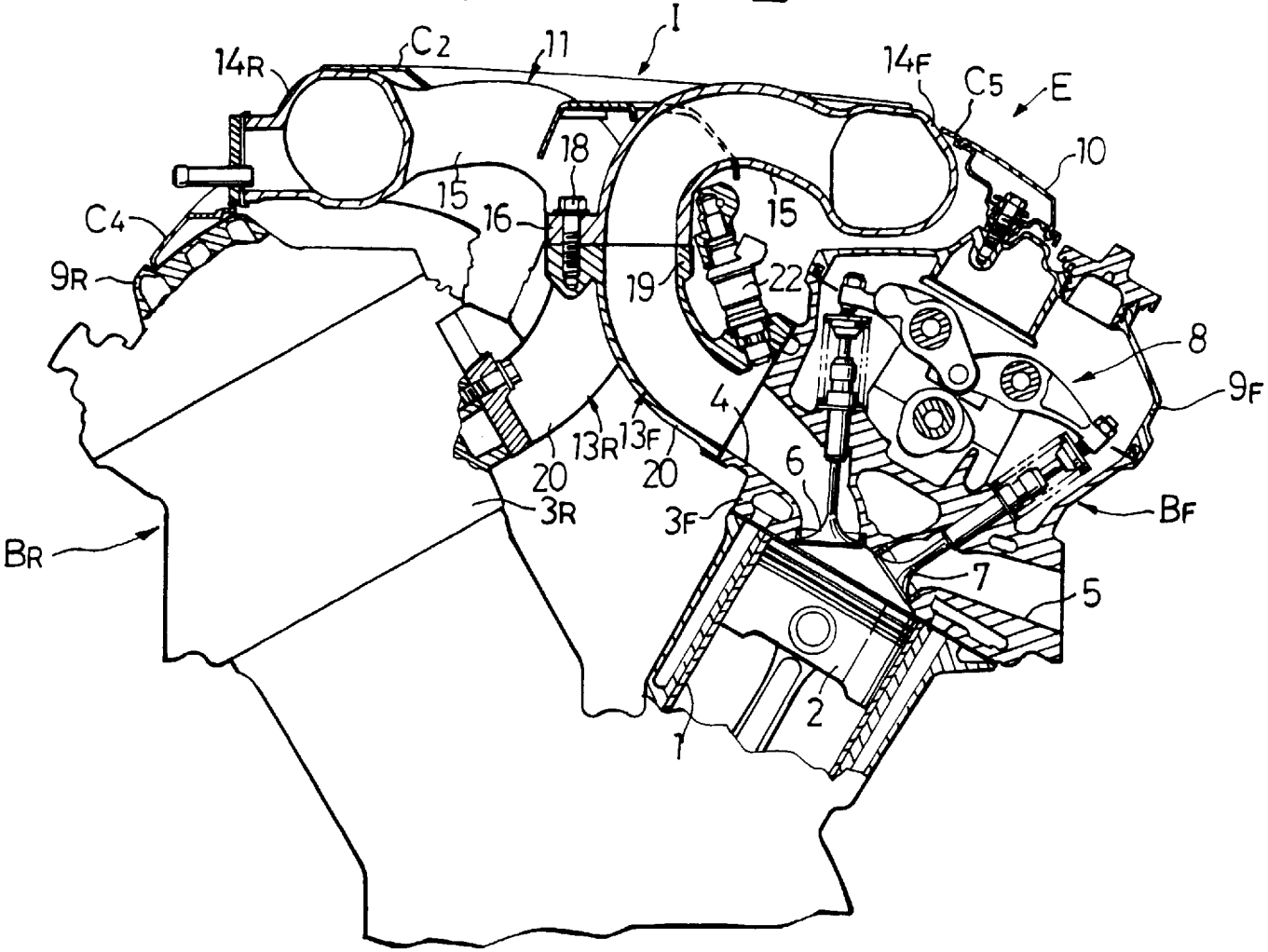

The present invention will now be described by way of a preferred embodiment with reference to the accompanying drawings. Referring to FIGS. 1 and 2, a V-shaped 6-cylinder engine E includes a front bank $B_F$ and a rear bank $B_R$ which open into a V-shape in the upper part. An intake manifold I is disposed in a space defined between the banks $B_F$ and $B_R$. Pistons 2 are slidably received in three cylinders 1 provided in each of the banks $B_F$ and $B_R$. Intake ports 4, exhaust ports 5, intake valves 6, exhaust valves 7 and valve operating devices 8 are provided in cylinder heads $\mathbf{3}_F$ and $\mathbf{3}_R$ coupled to upper portions of the cylinders 1. The valve operating devices 8 are covered with head covers $\mathbf{9}_F$ and $\mathbf{9}_R$ which are coupled to the cylinder head $\mathbf{3}_F$ and $\mathbf{3}_R$.

An upper surface of the engine E is covered with a first cover $C_1$, a second cover $C_2$, a third cover $C_3$, a fourth cover $C_4$ and a fifth cover $C_5$. The first, second, third, fourth and fifth covers $C_1$, $C_2$, $C_3$, $C_4$ and $C_5$ are positioned, so that they do not overlap on one another. A portion of the intake manifold I is exposed in the gaps defined between the covers $C_1$, $C_2$, $C_3$, $C_4$ and $C_5$. A name plate 10 is mounted on an upper surface of the fifth cover $C_5$.

Figure 3:
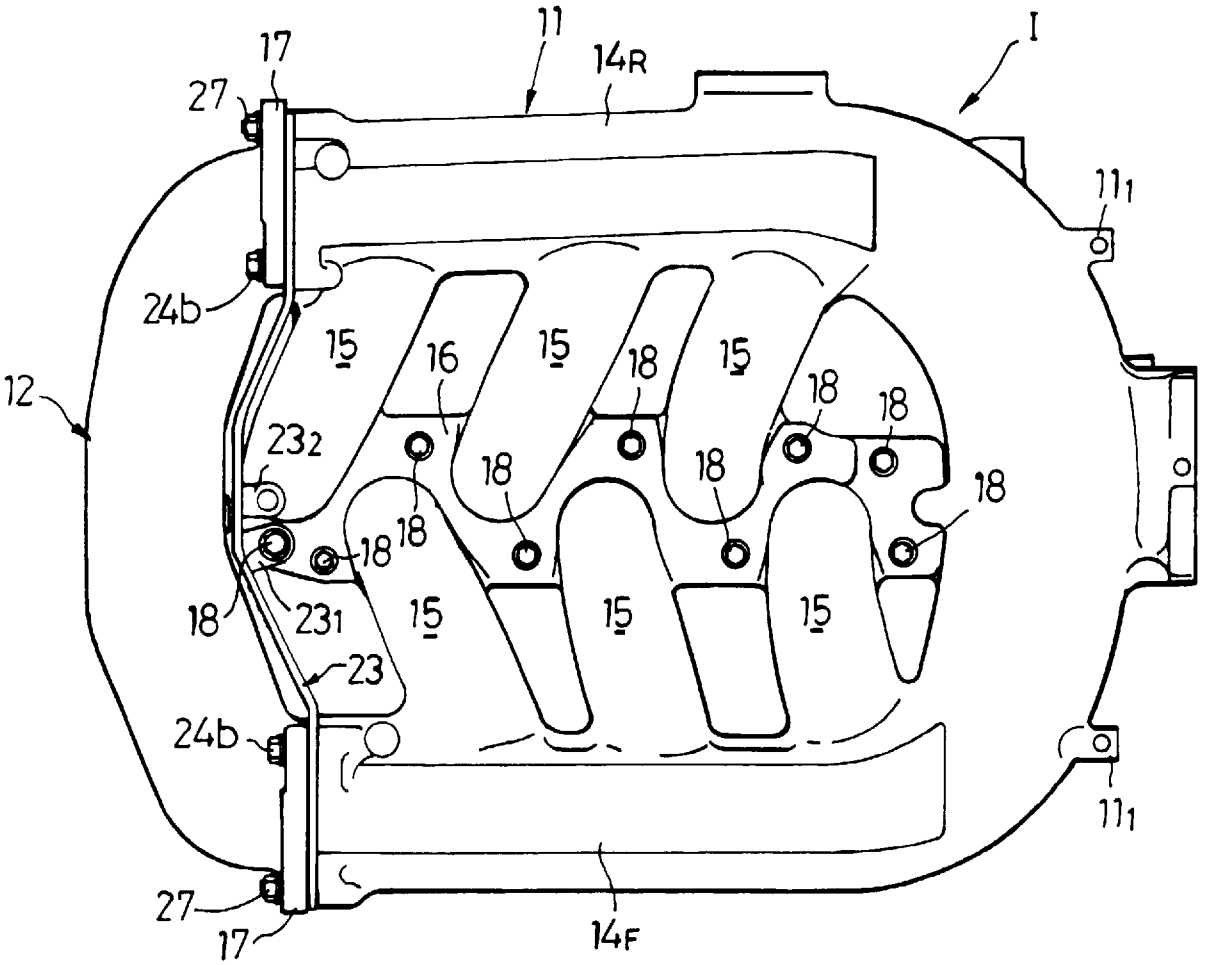
Figure 4:
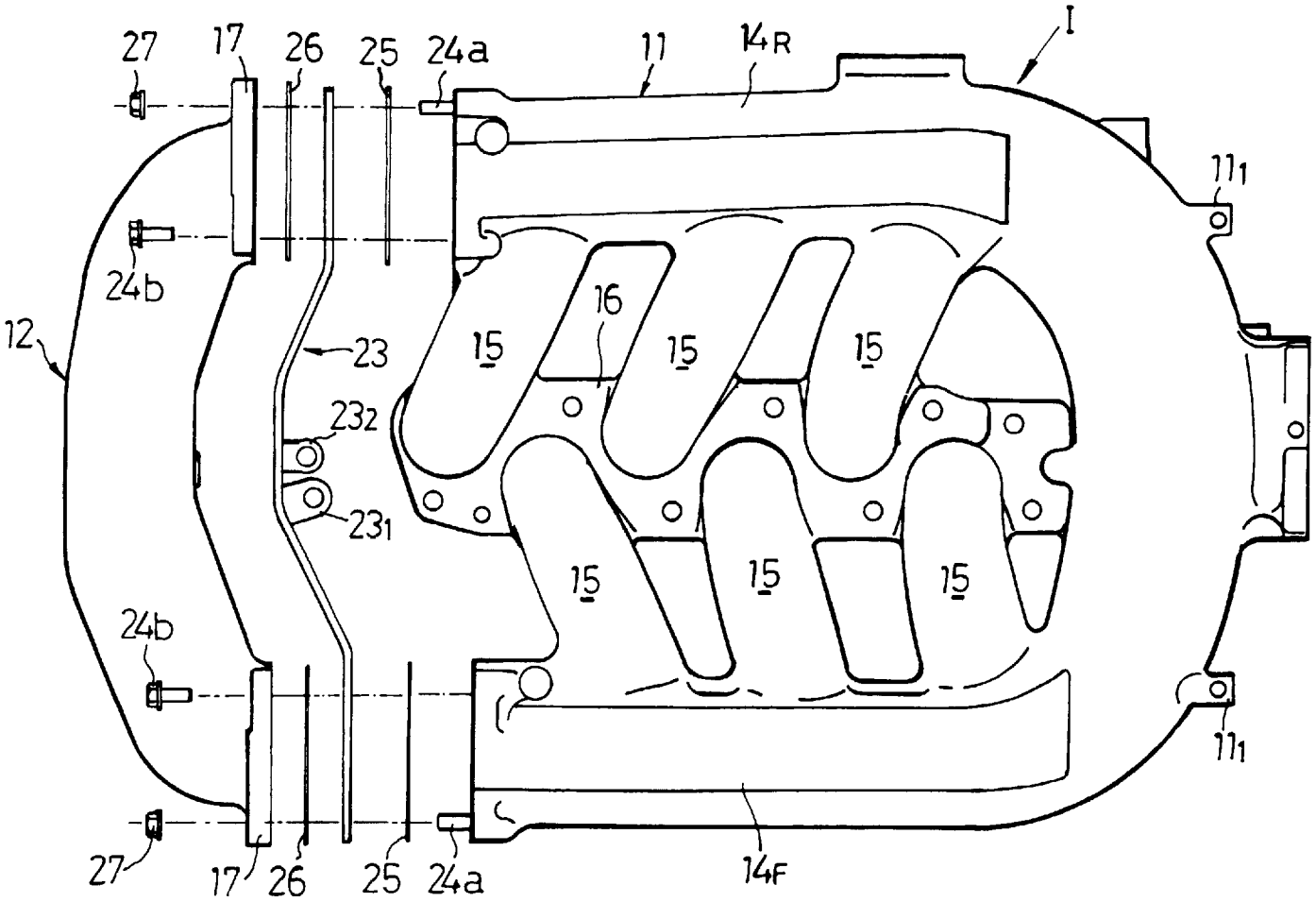

As can be seen from FIGS. 3 and 4, the intake manifold I is divided into a body section 11 and a connecting section 12 and is supported on the upper surfaces of injector bases $\mathbf{13}_F$ and $\mathbf{13}_R$ (see FIG. 2) which are coupled to the cylinder head $\mathbf{3}_F$ and $\mathbf{3}_R$ to support an injector (not shown).

The body section 11 comprises a front collection pipe $\mathbf{14}_F$ and a rear collection pipe $\mathbf{14}_R$ which are integrally formed to provide a substantially U-shape as viewed in a plane. Six upper independent intake pipes 15 are integrally formed in the collection pipes $\mathbf{14}_F$ and $\mathbf{14}_R$ in correspondence to the six cylinders 1, and an upper mounting flange 16 is integrally connected to lower portions of the upper independent intake pipes 15. The connecting section 12 is formed into an arcuate shape in order to connect the end of the front collection pipe $\mathbf{14}_F$ and a rear collection pipe $\mathbf{14}_R$ to define an annular intake resonance chamber. Mounting flanges 17, 17 are integrally formed at opposite ends of the connecting section 12. Each of the injector bases $\mathbf{13}_F$ and $\mathbf{13}_R$ comprises a lower mounting flange 19 coupled to the upper mounting flange 16 of the body section 11, by a plurality of bolts 18, and three lower independent intake pipes 20 which diverge from the lower mounting flanges 19 and which are coupled to a sidewall of the cylinder head $\mathbf{3}_F$ and $\mathbf{3}_R$.

The resonance chamber is formed into the annular shape by coupling of the body section 11 and the connecting section 12, and is connected to intake ports 4 in the six cylinders 1 through the upper and lower independent intake pipe 15 and 20, which communicate with each other. A throttle body 21 is connected to branch portions of the front and rear collection intake pipes $\mathbf{14}_F$ and $\mathbf{14}_R$ of the body section 11, and injectors 22 are supported at lower ends of the three lower independent intake pipes 20 of the injector bases $\mathbf{13}_F$ and $\mathbf{13}_R$.

Figure 10:
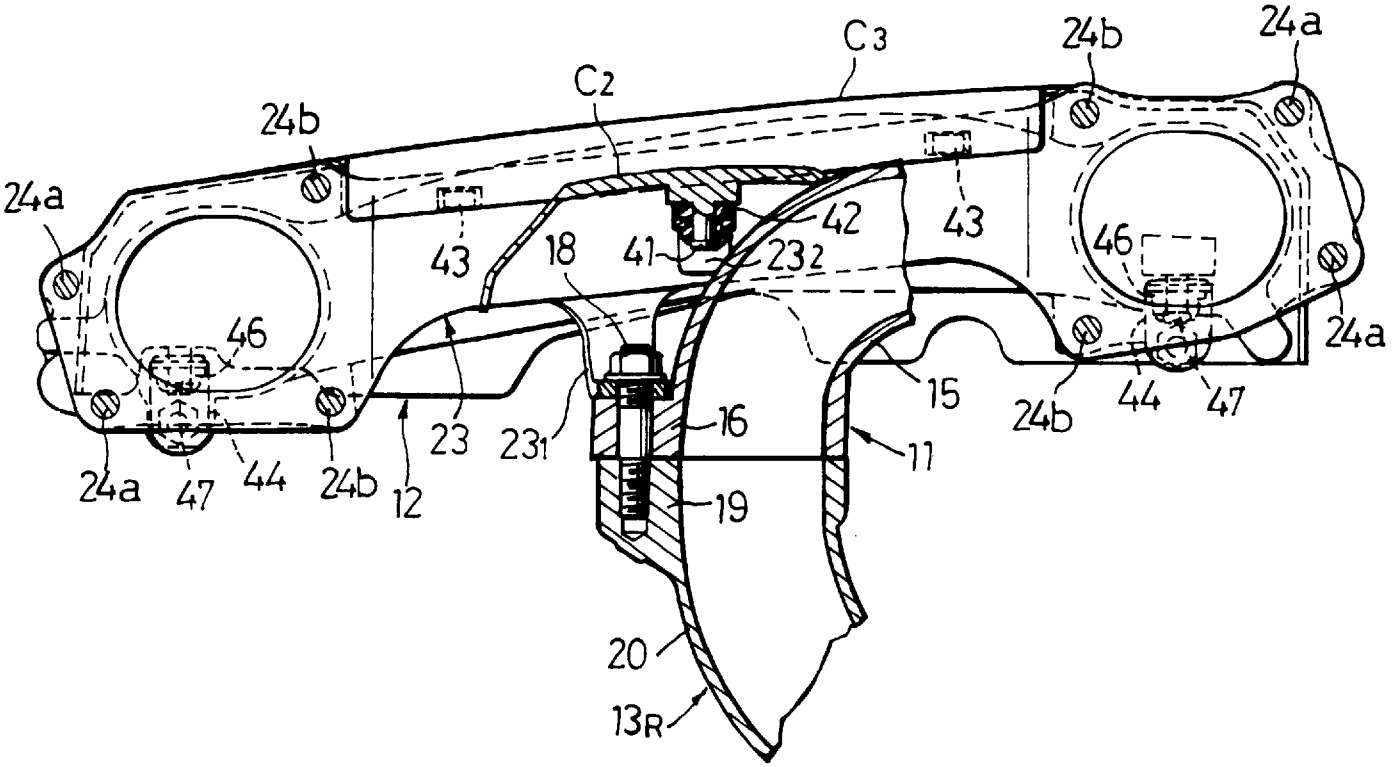
Figure 11:
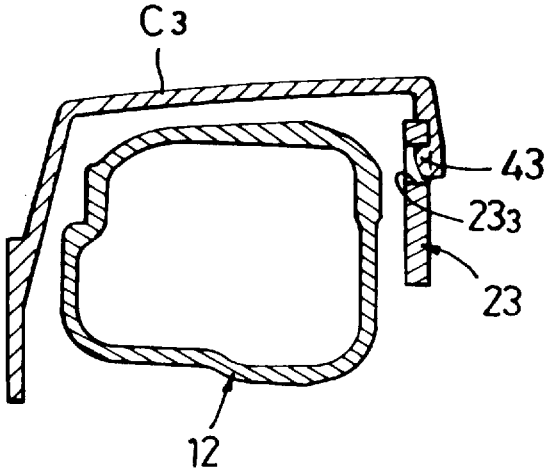
Figure 12:
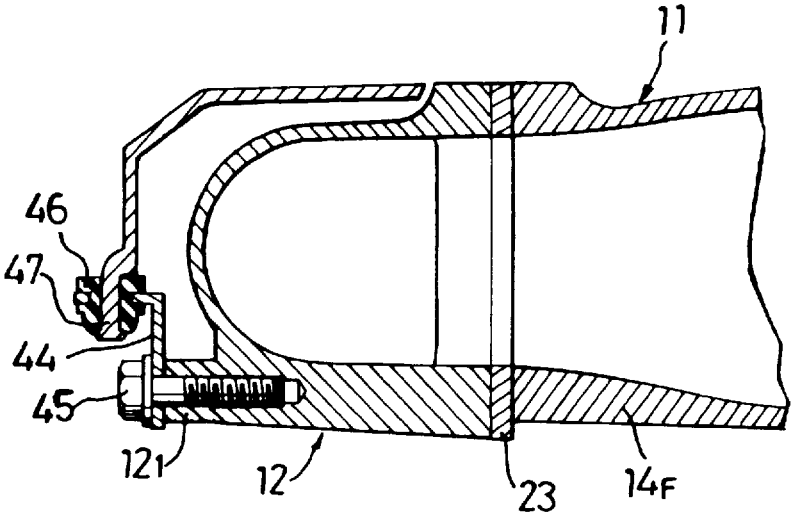

As can be seen from FIGS. 4 and 10, a plate-like mounting stay 23 is clamped between opposite ends of the body section 11 and the mounting flanges 17, 17 of the connecting section 12. More specifically, two stud bolts 24*a* are threadedly inserted into the opposite ends of the body section 11 and passed through gaskets 25, 25, the mounting stay 23, gaskets 26, 26 and the mounting flanges 17, 17 and are fastened by nuts 27. Two bolts 24*b* inserted into the mounting flanges 17, 17 are passed through the gaskets 26, 26, the mounting stays 23 and the gasket 25, 25 and fastened to the opposite ends of the body section 11.

As can be seen from FIGS. 3 and 10, a first support leg $\mathbf{23}_1$ and a second support leg $\mathbf{23}_2$ are integrally formed on one side of the mounting stay 23. The first support leg $\mathbf{23}_1$ is fastened to an upper surface of the upper mounting flange 16 by one of the bolts 18 which couple the lower mounting flanges 19, 19 of the injector bases $\mathbf{13}_F$ and $\mathbf{13}_R$ to the upper mounting flange 16 of the body section 11.

Since the mounting stay 23 clamped between the body section 11 and connecting section 12 of the intake manifold 1, is coupled to the upper surfaces of the injector bases $\mathbf{13}_F$ and $\mathbf{13}_R$ in the above manner, the body section 11 and connecting section 12 of the intake manifold I are rigidly coupled with the injector bases $\mathbf{13}_F$ and $\mathbf{13}_R$, so that the rigidity of the intake manifold I is enhanced. Moreover, a portion of the weight of the connecting portion 12 is directly supported utilizing the injector bases $\mathbf{13}_F$ and $\mathbf{13}_R$ directly coupled to the cylinder heads $\mathbf{3}_F$ and $\mathbf{3}_R$ with a high rigidity. Thus, it is possible to prevent the longitudinal deflection (see an arrow in FIG. 2) of the intake manifold I about the injector bases $\mathbf{13}_F$and $\mathbf{13}_R$ produced by the vibration of the engine E, particularly, the deflection of the connecting section 12 thereof to thereby enhance the deflection resistance.

The mounting stay 23 is fastened by utilizing stud bolts 24*a* and bolts 24*b* which couple the connecting section 12 to the body section 11 and hence, an exclusive fixing means for fixing the mounting stay 23 is not required. This results in a reduced number of parts. Moreover, the mounting stay 23 is disposed inside the body section 11 and the connecting section 12 which form an annular shape and hence, the compactness of the engine E is not affected. Further, the mounting stay 23 is coupled to the body section 11 and the connecting section 12 through the gaskets 25, 25; and 26, 26 and moreover, the injectors $\mathbf{13}_F$ and $\mathbf{13}_R$ on which the mounting stay 23 is supported are also coupled to the cylinder heads $\mathbf{3}_F$ and $\mathbf{3}_R$ through gaskets (not shown). Therefore, the vibration of the engine E is hardly transmitted to the intake manifold I through the mounting stay 23, which can also contribute to an enhancement in the silence of operation.

The intake manifold I is assembled only by coupling the previously formed assembly of the body section 11, the connecting section 12, and the mounting stay 23 to the injector bases $\mathbf{13}_F$ and $\mathbf{13}_R$ mounted on the cylinder head $\mathbf{3}_F$ and $\mathbf{3}_R$ by a bolt 18 from above. Therefore, the assemblability of the intake manifold I is good, and the assembling can be easily achieved in a short time.

If the body section 11 and the connecting section 12 are integrally formed, then the structure of a casting core is complicated, and also a closing plug for closing a sand withdrawing hole is required, resulting in an increased number of parts. However, if the body section 11 and the connecting section 12 are formed from separate members, the casting problem is solved. Moreover, the resonance frequency of the intake resonance chamber can be tuned to provide an enhancement in performance of the engine E by a simple change of only increasing or decreasing the volume of the connecting section 12. Further, the injector bases $\mathbf{13}_F$ and $\mathbf{13}_R$ are formed separate from the intake manifold I and hence, the intake manifold I can be easily produced by casting, and also the degree of freedom of the mounting position of the injectors 22 and the length of the independent intake pipes 15 and 20 can be increased to provide enhancement in performance of the engine E.

The structures of mounting of the first to fifth covers $C_1$ to $C_5$ will be described below in sequence.

(1) First cover $C_1$

The first cover $C_1$ covers a throttle cable, a fuel hose and the like from above, to provide an enhancement in the aesthetic sense. Further, the throttle cable and the fuel hose can be easily maintained by removing the first cover $C_1$.

Figure 5:
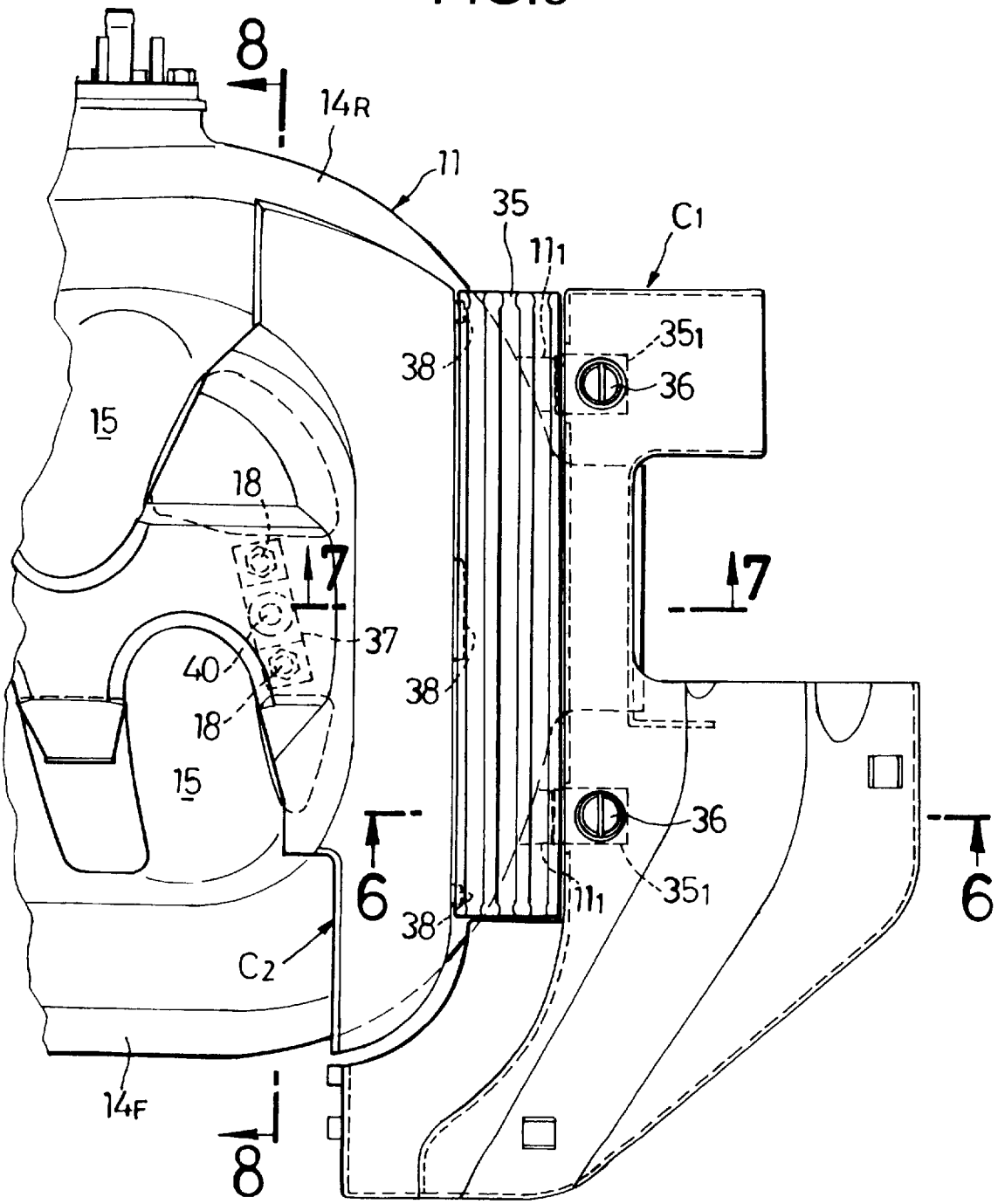
Figure 6:
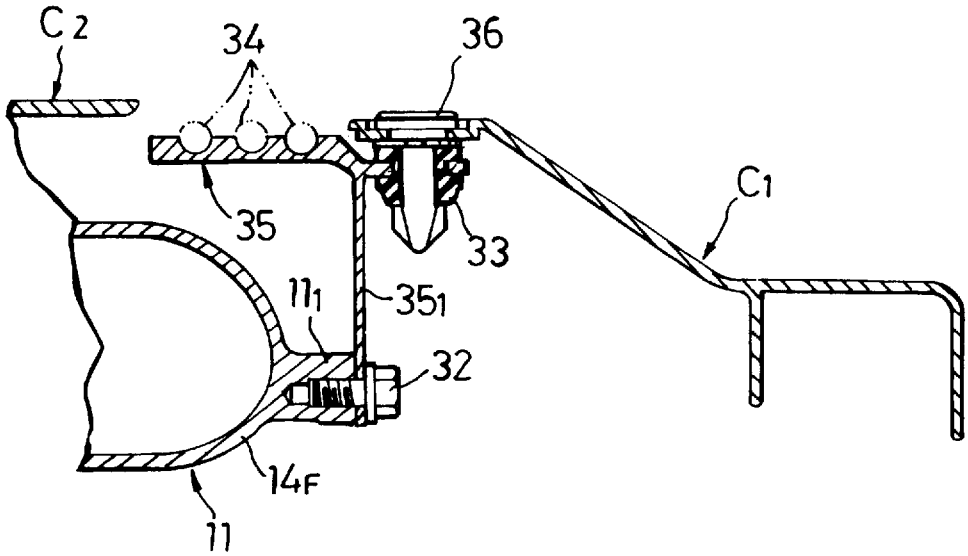

As shown in FIGS. 5 and 6, L-shaped mounting brackets $\mathbf{35}_1$, $\mathbf{35}_1$ are fixed by bolts 32, 32, to two boss portions $\mathbf{11}_1$, $\mathbf{11}_1$ projecting from the body section 11 of the intake manifold I and are formed integrally with a high-tension cord rail 35 which retains high-tension cords 34 (see FIG. 1) extending from three spark plugs in the front bank $B_F$ of the engine E. The high-tension cord rail 35 and the first cover $C_1$ are simultaneously fixed to the body section 11 of the intake manifold I by fitting two clips 36, 36 passing through the first cover $C_1$ from above, into rubber grommets 33, 33 mounted on the top surfaces of the mounting brackets $\mathbf{35}_1$, $\mathbf{35}_1$.

(2) Second cover $C_2$

Figure 7:
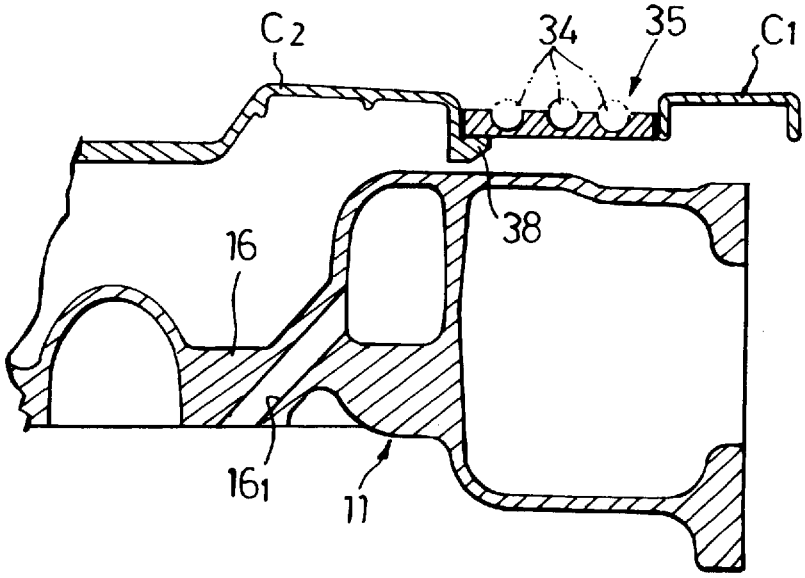
Figure 8:
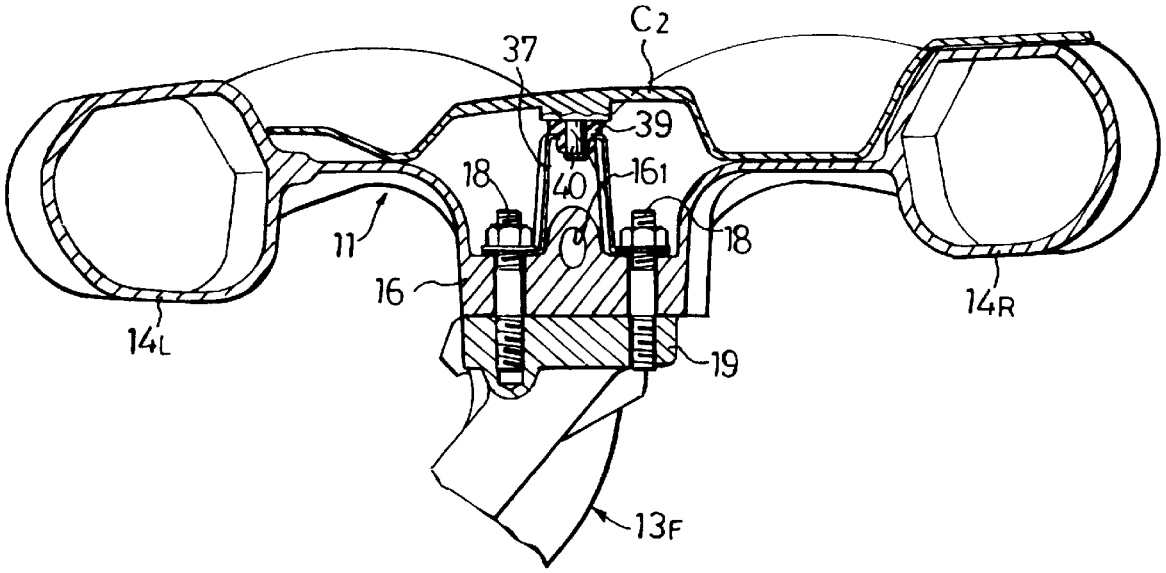
Figure 9:
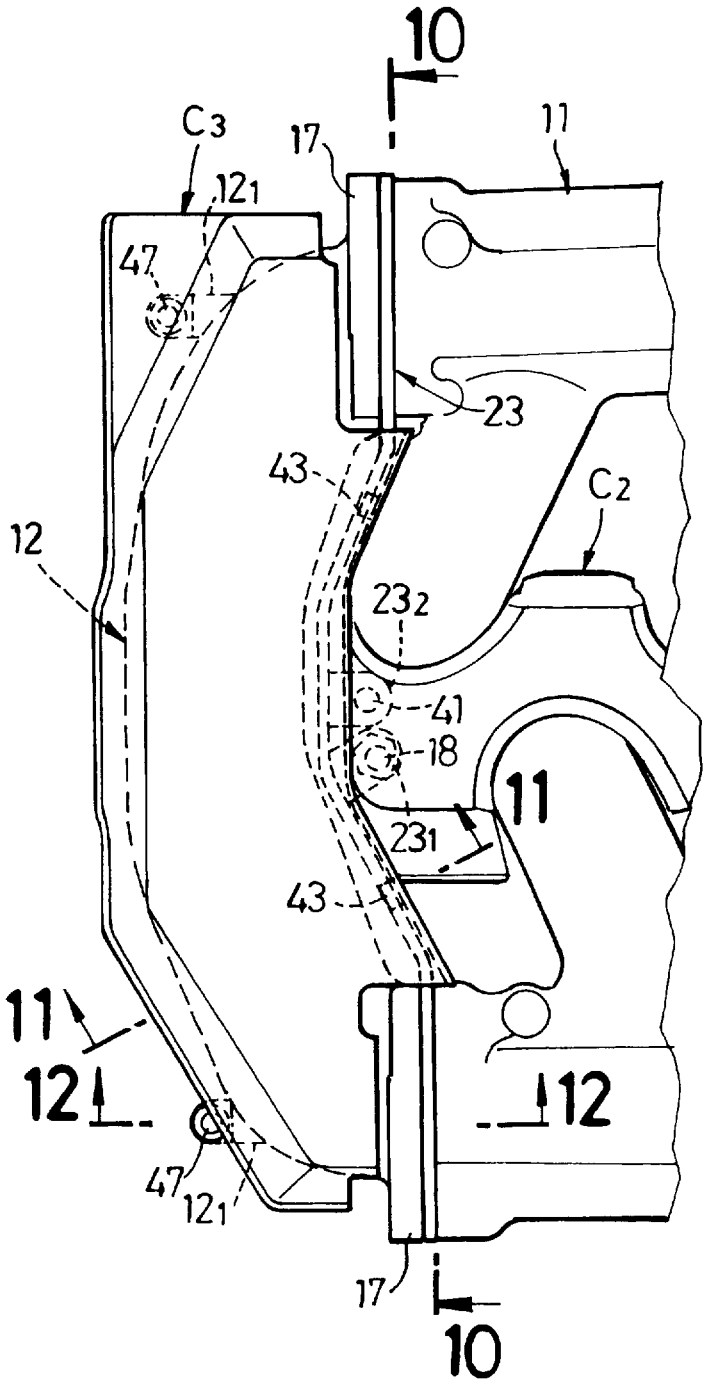

The second cover $C_2$ has the function of covering a portion of the body section 11 of the intake manifold I and the bolts 18 (see FIG. 3) for coupling the body section 11 to the injector bases $\mathbf{13}_F$ and $\mathbf{13}_R$ from above to enhance the aesthetic sense. The cover $C_2$ also covers the upper mounting flange 16 having an EGR gas passage 161 (see FIGS. 7 and 8) provided therein, for supplying EGR gas to the branching portion of the collection intake pipes $^{14}$L and $\mathbf{14}_R$ of the body section 11, to thereby provide the function of preventing the lowering of the temperature of the EGR gas flowing through the EGR passage $\mathbf{16}_1$.

As shown in FIGS. 5 and 7 to 10, a gate-like mounting bracket 37 is coupled to an upper surface of the upper mounting flange 16 by the two bolts 18, 18 which couple the upper mounting flange 16 of the body section 11 to the lower mounting flange 19 of the injector base $\mathbf{13}_F$. The three locking claws 38 projectingly provided at one end of the second cover $C_2$, are locked on the lower surface of the high tension cable rail 35. The second cover $C_2$ is fixed at one end to the body section 11 of the intake manifold I, by fitting a clip 40 projectingly provided on a lower surface of the second cover $C_2$, from above, into the rubber grommet 39 mounted on the mounting bracket 37. The other end of the second cover $C_2$ is also fixed by fitting a clip 41 projecting from the lower surface thereof, from above, into the rubber grommet 42 mounted on the second support leg $\mathbf{23}_2$ of the mounting stay 23.

(3) Third cover $C_3$

The third cover $C_3$ has the function of covering the connecting section 12 of the intake manifold I from above, to enhance the heat retaining property and also to cover the mounting stay 23 from above, to enhance the aesthetic sense.

As shown in FIGS. 9 to 12, two locking claws 43, 43 formed on the third cover $C_3$ are engaged into two locking bores $\mathbf{23}_3$, $\mathbf{23}_3$ defined in the mounting stay 23, respectively. Further, L-shaped brackets 44, 44 are fixed to two boss portions 121, 121 formed on the connecting section 12 by bolts 45, 45, respectively. Clips 47, 47 projectingly provided on a lower surface of the third cover $C_3$, are fitted into rubber grommets 46, 46 mounted on the mounting brackets 44, 44 from above, thereby fixing the third cover $C_3$ to the connecting section 12 and the mounting stay 23.

(4) Fourth cover $C_4$

The fourth cover $C_4$ has the function of covering an upper portion of the rear collection intake pipe $\mathbf{14}_R$ to ensure the heat retaining property when at a low temperature.

Figure 13:
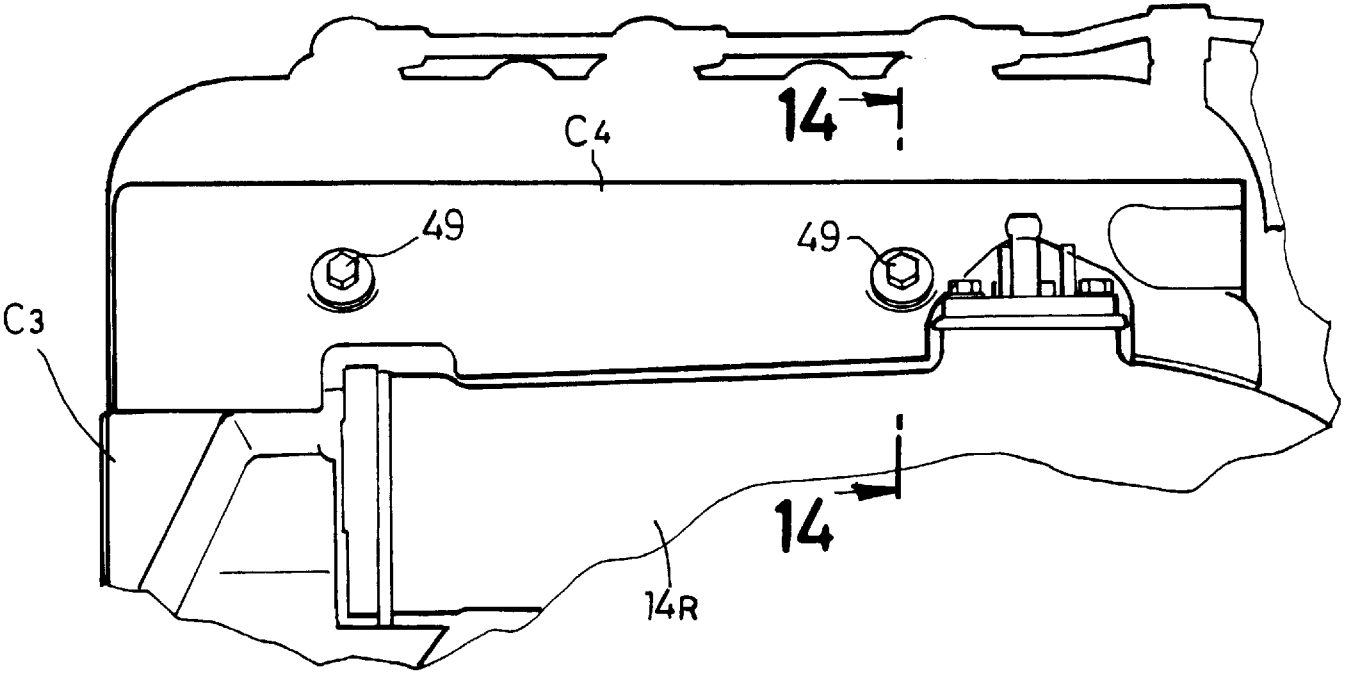
Figure 14:
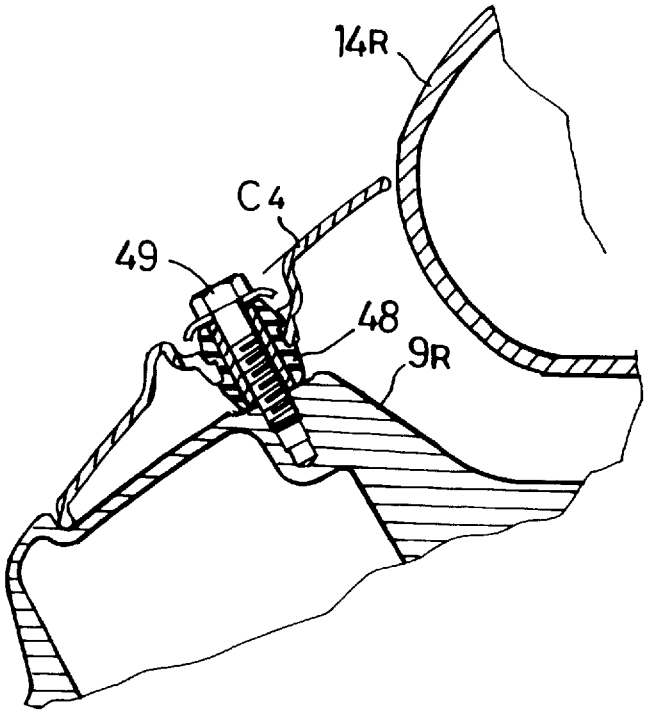

As shown in FIGS. 13 and 14, the fourth cover $C_4$ is fixed to the head cover $\mathbf{9}_R$ by threadedly inserting two bolts 49, 49 passed through rubber grommets 48, 48 mounted at two points on the fourth cover $C_4$, into the head cover $\mathbf{9}_R$.

(5) Fifth cover $C_6$

The fifth cover $C_5$ has the function of covering a gap between the head cover 9F and the front collection intake pipe $\mathbf{14}_F$ in the front bank $B_F$, to enhance the aesthetic sense.

Figure 15:
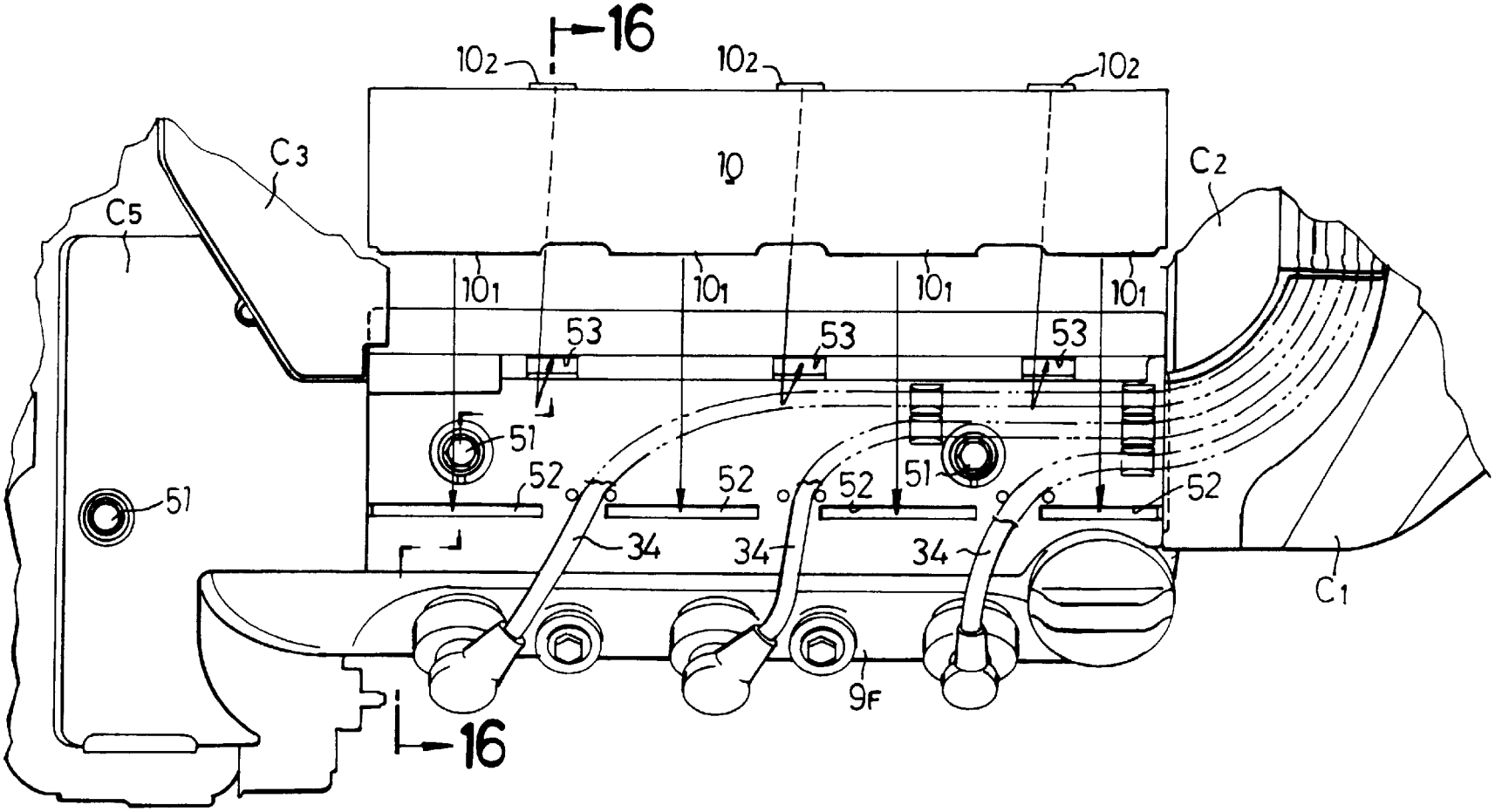
Figure 16:
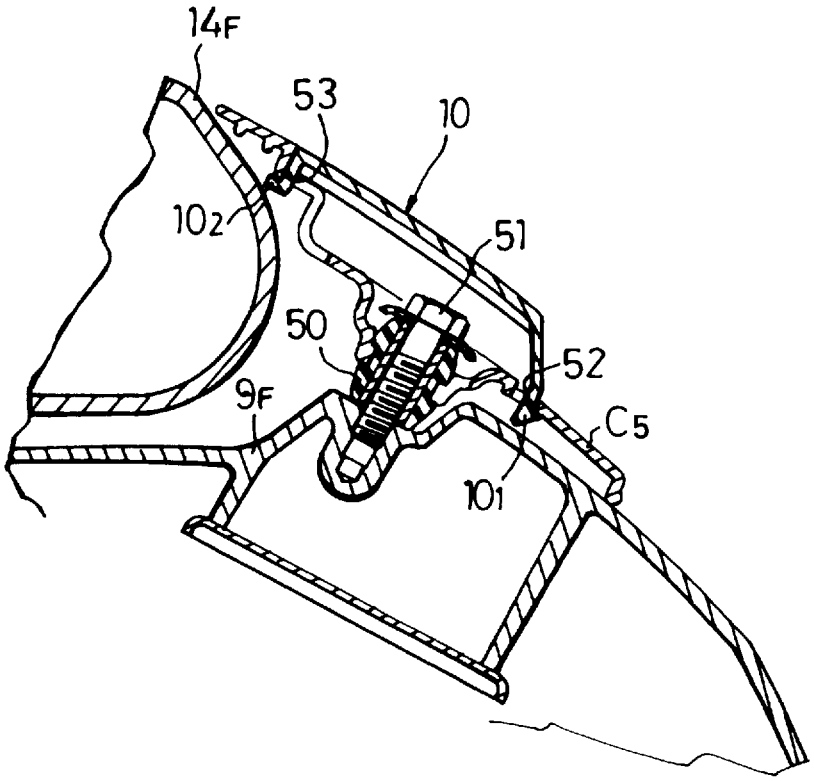

As shown in FIGS. 15 and 16, the fifth cover $C_5$ is fixed to the head cover $\mathbf{9}_F$ by threadedly inserting three bolts 51 through rubber grommets 50 mounted at three points on the fifth cover $C_5$, into the head cover $\mathbf{9}_F$. Four first locking bores 52 and three second locking bores 53 are defined in the fifth cover $C_5$. A name plate 10 is fixed to an upper surface of the fifth cover $C_5$ by bringing four locking claws $\mathbf{10}_1$ formed in the name plate 10, into engagement in the first locking bores 52 and bringing three second locking claws $\mathbf{10}_2$ into engagement into the second locking bores 53.

Since the detachable first to fifth covers $C_1$ to $C_5$ are independently mounted, as described above, only the desired cover needs to be removed to effect maintenance, leading to an enhanced workability.

The preferred embodiment may be modified where for example, rather than the intake manifold I being divided into the two members, the body section 11 and the connecting section 12 in the above described embodiment, it may be divided into three or more members. In this case, the number of the mounting stays 23 may be two or more. The injector base is used as the intake manifold supporting member in the above embodiment, but any other member such as the cylinder head, the cylinder block and the like may be used, if it has a high rigidity.

Although the embodiment of the present invention has been described in detail, it will be understood that the present invention is not limited to the above-described embodiment, and various modifications in design may be made without departing from the spirit and scope of the invention defined in claims.

What is claimed is:

1. An intake system for an engine, said intake system comprising an intake manifold having a plurality of members coupled to one another, a mounting stay clamped between the coupled surfaces of said plurality of members and an intake manifold supporting member, for supporting said mounting stay thereon, wherein said plurality of members comprising said intake manifold include a body section having a substantially U-shaped collection intake pipe, and a connecting section for connecting said opposite ends of said body section to define an annular resonance chamber.

2. An intake system in an engine according to claim 1, wherein said intake manifold supporting member is an injector base for supporting a fuel injector, said injector base being coupled to a cylinder head of said engine.

3. An intake system in an engine according to claim 1, wherein said mounting stay is disposed inside said body section.

4. An intake system in an engine according to claim 1 further including a plurality of cover members for covering portions of the engine, wherein a gap is located between at least two of said cover members and wherein a portion of said intake manifold is exposed in the gap between said cover members.

* * * * *